US007600759B2

(12) United States Patent
Crawley et al.

(10) Patent No.: US 7,600,759 B2
(45) Date of Patent: Oct. 13, 2009

(54) MULTI-SPORTS BALL RETURN NET SYSTEM AND METHOD THEREOF

(75) Inventors: Paul A. Crawley, Bergen County, NJ (US); Matthew J. Crawley, Horry County, SC (US)

(73) Assignee: The Net Return, LLC, Fairlawn, NJ (US)

( * ) Notice: Subject to any disclaimer, the term of this patent is extended or adjusted under 35 U.S.C. 154(b) by 0 days.

(21) Appl. No.: 11/881,351

(22) Filed: Jul. 26, 2007

(65) Prior Publication Data

US 2009/0029804 A1 Jan. 29, 2009

(51) Int. Cl.
*A63B 63/00* (2006.01)

(52) U.S. Cl. ..... 273/396; 273/400; 473/434; 473/438; 473/432; 473/454; 473/478

(58) Field of Classification Search ..... 273/395–402; 473/476, 478, 434, 435, 454, 456
See application file for complete search history.

(56) References Cited

U.S. PATENT DOCUMENTS

| | | | | | |
|---|---|---|---|---|---|
| 920,907 | A | | 5/1909 | Bolton | |
| 1,430,280 | A | * | 9/1922 | Bolton | 473/197 |
| 1,540,670 | A | * | 6/1925 | Vidmer | 473/190 |
| 2,805,070 | A | | 9/1957 | Waters | |
| 3,001,795 | A | | 9/1961 | Johnson | |
| 3,227,449 | A | | 1/1966 | Schwab | |
| D259,052 | S | | 4/1981 | Gilman | |
| 4,556,219 | A | | 12/1985 | Tillery | |
| 4,703,931 | A | * | 11/1987 | Steen | 473/435 |
| 4,723,780 | A | | 2/1988 | Vinzetta | |
| 4,786,053 | A | * | 11/1988 | Barnes, Jr. | 473/416 |
| 4,836,542 | A | | 6/1989 | Crawley | |
| 4,905,996 | A | | 3/1990 | Tallent et al. | |
| 5,037,095 | A | | 8/1991 | Nedwick | |
| 5,088,740 | A | * | 2/1992 | Peterson | 273/410 |
| 5,180,167 | A | | 1/1993 | Felix | |
| 5,249,796 | A | * | 10/1993 | Silvi | 473/416 |
| 5,269,527 | A | | 12/1993 | Noval | |
| D353,865 | S | | 12/1994 | Smith | |
| 5,427,381 | A | * | 6/1995 | Macaluso et al. | 273/400 |
| 5,539,957 | A | | 7/1996 | Schmidt | |
| 5,558,338 | A | * | 9/1996 | Taub | 473/416 |
| 5,580,064 | A | * | 12/1996 | Childers, Jr. | 273/400 |
| 5,842,940 | A | | 12/1998 | Macaluso | |
| 5,947,831 | A | | 9/1999 | McCarthy | |
| 5,976,023 | A | | 11/1999 | Cho | |

(Continued)

FOREIGN PATENT DOCUMENTS

| | | |
|---|---|---|
| FR | 2605776 | 4/1988 |

*Primary Examiner*—Mark S Graham
(74) *Attorney, Agent, or Firm*—Howard C. Miskin, Esq.; Gloria Tsui-Yip, Esq.

(57) ABSTRACT

A multi-sports ball return net system and a method thereof that consistently returns a ball hit, kick, thrown or strike into it directly to a user and is portable, easy to assemble and disassemble. The multi-sports ball return net system has a frame and a net mounted across the frame. The net forms an upper U-shape forward bulging pillow and a lower U-shape channel or hammock. A ball propelled into the U-shape pillow drops down to the U-shape channel, which funnels the ball to the lowest and central point of the U-shape channel for discharge toward the user.

36 Claims, 10 Drawing Sheets

U.S. PATENT DOCUMENTS

| | | | | |
|---|---|---|---|---|
| D420,074 | S | 2/2000 | Whitham-Taudien | |
| 6,135,894 | A | 10/2000 | Cho | |
| 6,264,570 | B1 | 7/2001 | Yoon | |
| 6,315,677 | B1 | 11/2001 | Sandlin | |
| 6,319,145 | B1 * | 11/2001 | Coughlan | 473/197 |
| 6,485,373 | B1 | 11/2002 | Stephens | |
| 6,514,149 | B2 * | 2/2003 | Yoon | 473/197 |
| 6,517,444 | B1 | 2/2003 | Yoon | |
| 6,543,776 | B2 | 4/2003 | Macaluso | |
| 6,620,064 | B2 | 9/2003 | Nickerson | |
| 6,793,594 | B1 * | 9/2004 | Grant | 473/476 |
| 6,905,418 | B2 | 6/2005 | Rhee | |
| 6,929,569 | B1 | 8/2005 | Wang | |
| 7,021,630 | B1 * | 4/2006 | Cho | 273/401 |
| 7,056,241 | B1 | 6/2006 | Ishino | |
| 7,118,487 | B2 | 10/2006 | Turcot | |
| D540,407 | S | 4/2007 | Grant | |
| 2002/0049092 | A1 | 4/2002 | Yoon | |
| 2002/0115508 | A1 | 8/2002 | Bourdages | |
| 2003/0032493 | A1 * | 2/2003 | Lin | 473/197 |
| 2003/0224866 | A1 * | 12/2003 | Chen | 473/197 |
| 2004/0157687 | A1 | 8/2004 | Bourdages | |
| 2005/0176518 | A1 | 8/2005 | Doherty et al. | |
| 2005/0200079 | A1 * | 9/2005 | Barber | 273/400 |
| 2006/0091610 | A1 * | 5/2006 | Williams | 273/398 |
| 2006/0105865 | A1 | 5/2006 | Bourdages | |

* cited by examiner

MULTI-SPORTS BALL RETURN NET SYSTEM AND METHOD THEREOF

FIELD OF THE INVENTION

The invention relates to a multi-sports ball return net system and method thereof. Specifically, it relates to an improved return net system that is portable and returns a ball propelled into the net directly towards the user.

BACKGROUND OF THE INVENTION

For sports that use a ball, it is common for a person to practice making contact with (i.e. by hitting, kicking, throwing or striking) the ball to propel it in a direction. Repetition during practice helps achieve precision in making contact with the ball in the proper manner to propel the ball in a desired direction. To be able to practice hitting, kicking, throwing or striking a ball, there is a need to constantly retrieve the ball, so that it can be hit, kicked, thrown or strike repeatedly.

One way to achieve this is to have another person catch the ball and return it to the hitter. Another way to achieve this is to utilize a net system. A typical prior art net system includes a rectangular shaped frame with a net mounted across the frame. A ball hit into the net is bounced back, usually not directly to the user unless the ball hit the net at an angle normal to the plane of the net. Therefore, a user of such prior art net system has to, disadvantageously, constantly move to different positions to catch the returned ball. Examples of similar prior art systems are disclosed in U.S. Pat. Nos. 4,905,996 and 5,269,527.

Another prior art net system utilizes a net that is configured into a pocket shape to collect balls, which may then be returned to the user via formed chutes. With the need of extraneous structure and parts such as chutes disadvantageously make such prior art system more difficult to transport or assembled. Examples of similar prior art systems are disclosed in U.S. Pat. Nos. 2,805,070 and 6,620,064.

Therefore, there is a need for a portable multi-sports ball return net system that can be easily transported and returns a ball to the user with minimal or no effort of the user to retrieve the returned ball.

SUMMARY OF THE INVENTION

The present invention provides a multi-sports ball return net system and a method thereof that consistently returns a ball hit, kick, thrown or strike into it directly to a user and is portable, easy to assemble and disassemble.

The multi-sports ball return net system of the present invention comprises a frame and a net mounted across the frame. The net forms an upper U-shape forward bulging pillow and a lower U-shape channel or hammock. A ball propelled into the U-shape pillow drops down to the U-shape channel, which funnels the ball to the lowest and central point of the U-shape channel for discharge toward the user.

The frame of the multi-sports ball return net system comprises a plurality of substantially straight tubular members that are interconnected to form an upstanding frame having a S-shape profile. The frame includes an upper front transverse member, each end of which is connected to an upper rearwardly extending horizontal member, each end of which is connected to an upper downwardly extending vertical member, each end of which is connected to an intermediate downwardly extending and forwardly inclined member, each end of which is connected to a lower downwardly extending vertical member, each end of which is connected to a lower rearwardly extending horizontal member, each end of which is connected to the two ends of a lower rear transverse member.

The net of the multi-sports ball return net system has a substantially isosceles trapezoidal shape. The longer parallel edge of the net is sleeved across the upper front transverse member and the pair of upper horizontal members. Each side edge of the net is sleeved over one of the pair of upper vertical member, intermediate inclined member and lower vertical member.

The multi-sports ball return net system of the present invention can be used to consistently return balls to the user in such sports as golf, football (punting and place-kicking), soccer, baseball (hitting and pitching), softball (hitting and pitching), lacrosse, and street hockey.

BRIEF DESCRIPTION OF THE DRAWINGS

Preferred embodiments of the present invention have been chosen for purposes of illustration and description and are shown (not to scale) in the accompanying drawings forming a part of the specification wherein.

DETAILED DESCRIPTION OF THE PREFERRED EMBODIMENTS

Figure 1:
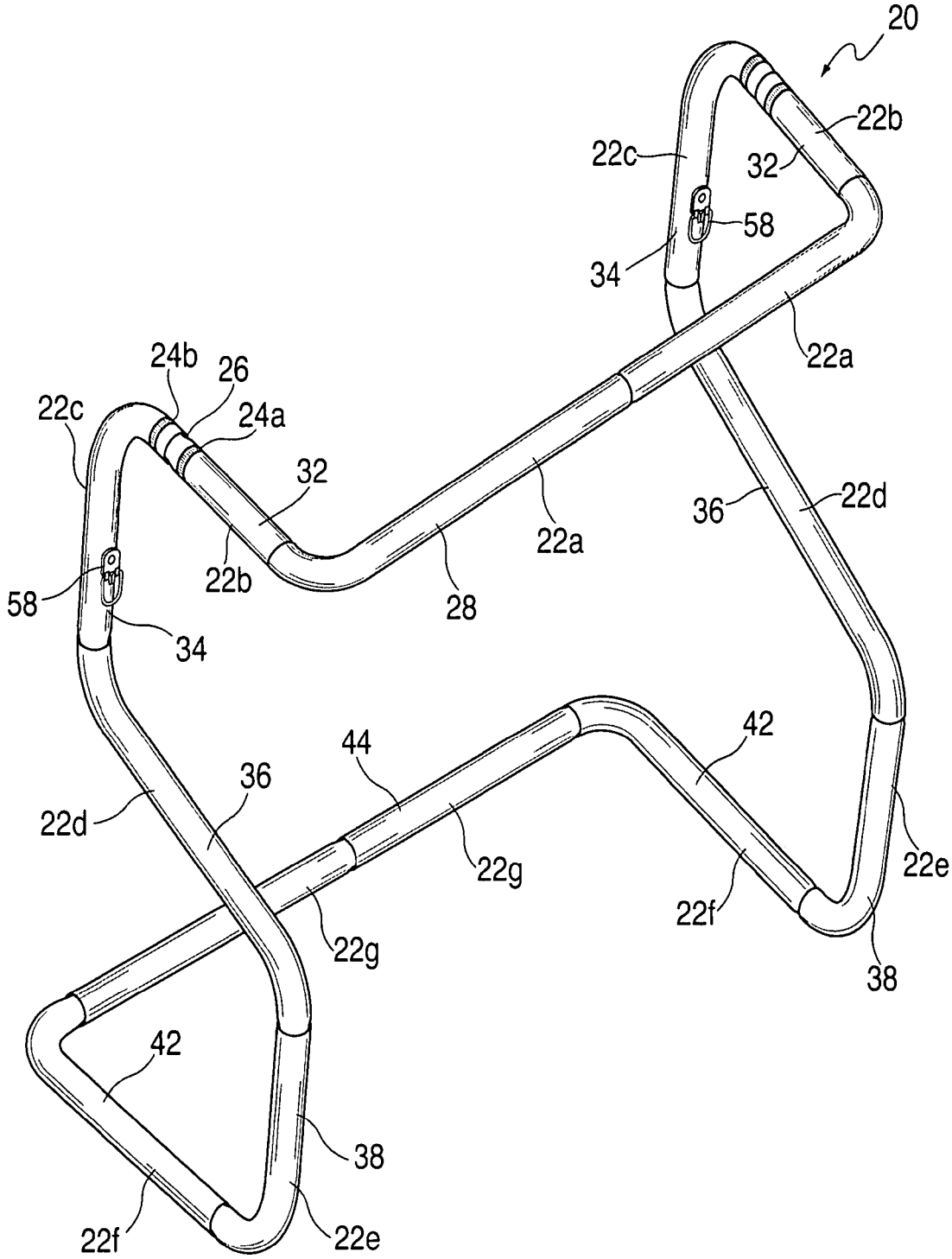
FIG. 1 shows a top perspective view of the frame of the multi-sports ball return net system of the present invention.

With reference to the drawing wherein the same reference number illustrates the same element throughout, FIG. 1 shows the frame 20 of the multi-sports ball return net system 10 of the present invention.

As shown in FIG. 1, the frame 20 of the multi-sports ball return net system 10 is constructed from a plurality of tubular elements 22. The embodiment shown in FIG. 1 has 14 tubular elements 22—two each of 22*a*-22*g*. The tubular elements 22 may be made of a light weight material such as aluminum, plastic or polyvinyl chloride (PVC). Each tubular element 22 may have one tapered end for fitting into another tubular element's 22 non-tapered end. The tubular elements 22 may be interconnected by any methods known to connect tubular elements, such as snap fitting or frictional fitting. The tubular elements 22 may also be interconnected with the use of a pushbutton on the tapered end with a corresponding opening on the non-tapered end.

To further facilitate assembly of the frame 20, the corresponding ends of each pair of tubular elements 22 at each interconnection have matching color codes or bands, as illustrated by matching color bands 24*a* and 24*b* at interconnection 26. The color coding of the tubular elements 22 allow a user to simply join the tubular elements 22 having matching colors (e.g. red to red, blue to blue, etc.) to form an interconnection. For the embodiment shown in FIG. 1, fourteen (14) color codes or bands are required (not shown). Other types of matching indicia can be used to facilitate matching the tubular elements 22 to form an interconnection.

The interconnection and color coding of the tubular elements 22 facilitate the assembly and disassembly of the frame 20 of the multi-sports ball return net system 10 to make it easily and quickly transportable to different locations. It takes approximately 5 minutes to assemble the frame 20 as shown in FIG. 1.

Tubular elements 22 are assembled as shown in FIG. 1 to form the frame 20—the two tubular elements 22*a* interconnect to form the upper front transverse member 28; each end of the two tubular elements 22*a* interconnects with a tubular element 22*b* to form a pair of parallel upper rearwardly extending horizontal members 32; each end of the two tubular elements 22*b* interconnects with a tubular element 22*c* to form a pair of parallel upper downwardly extending vertical member 34; each end of the two tubular elements 22*c* interconnect with a tubular element 22*d* to form a pair of parallel intermediate downwardly extending and forwardly inclined member 36; each end of the two tubular elements 22*d* interconnect with a tubular element 22*e* to form a pair of parallel lower downwardly extending vertical member 38; each end of the two tubular elements 22*e* interconnect with a tubular element 22*f* to form a pair of parallel lower rearwardly extending horizontal member 42; the two tubular elements 22*g* interconnect to form the lower rear transverse member 44; each end of the two tubular elements 22*f* interconnects with the lower rear transverse member 44.

Figure 2:
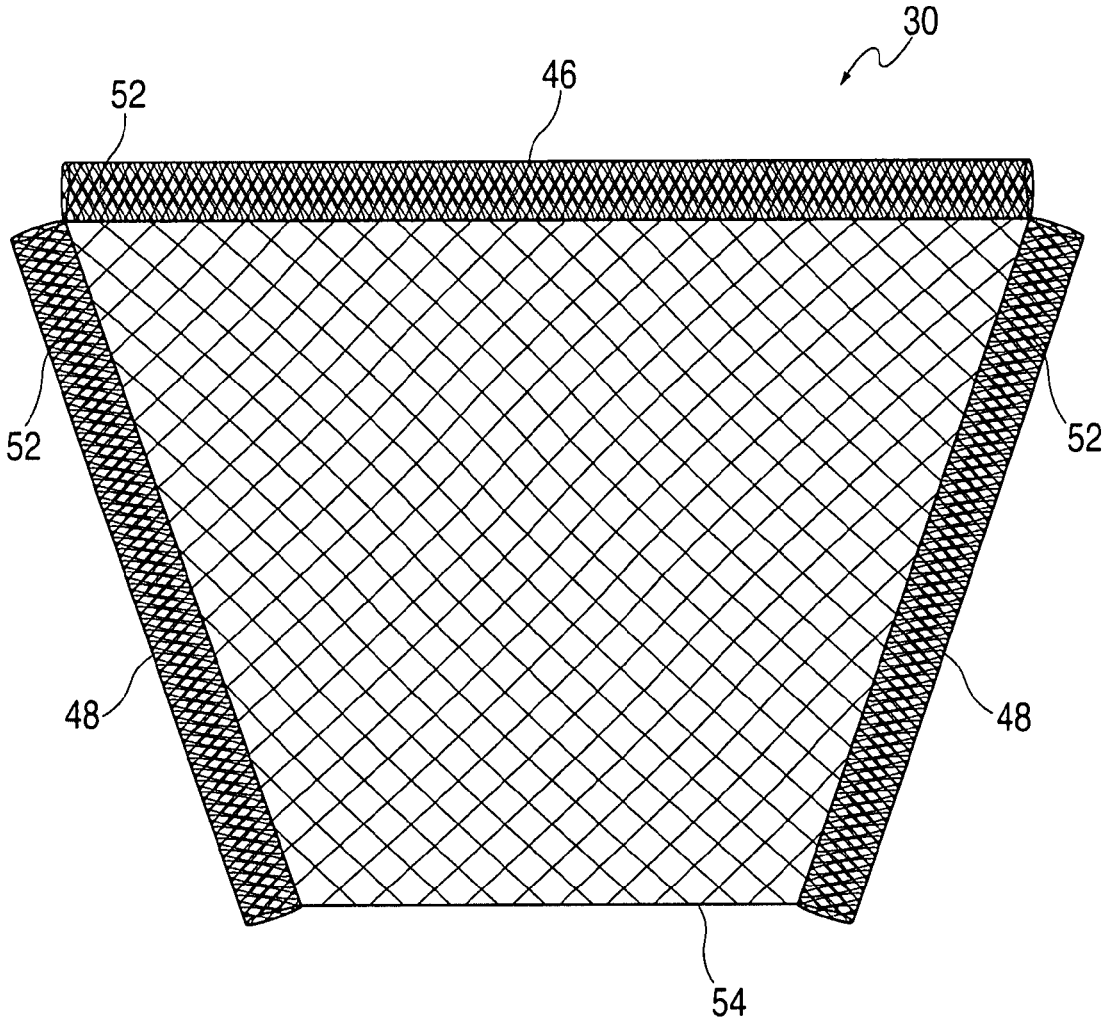
FIG. 2 shows a front view of the net of the multi-sports ball return net system of the present invention.

As shown in FIG. 2, frame 20 has a S-shape profile. The upper front transverse member 28 is in substantial vertical alignment with the lower vertical member 38 and the lower rear transverse member 44 is in substantial vertical alignment with the upper vertical member 34. This configuration allows the frame 20 to be self-supporting without any additional mounting or stabilizing elements.

The frame 20 can have various dimensions, depending on the type of sports the ball return net system 10 is used for and the space where the ball return net system 10 is being used. The embodiment shown in FIGS. 1 and 3 has a width of 8', height of 7'5" and a depth of 38". Using lightweight aluminum tubular elements 22 that are 1.5" in diameter, the frame 20 weighs approximately 20 lbs. When disassembled, the tubular elements 22 can easily fit in a bag 55" in length and 12" in diameter to make it easily transportable.

FIG. 2 shows the net 30 of the multi-sports ball return net system 10 of the present invention. Net 30 has a substantially isosceles trapezoidal shape. Each of the longer parallel edge 46 and the side edges 48 of the net 30 has a sleeve 52 for mounting onto the frame 20.

Figure 3:
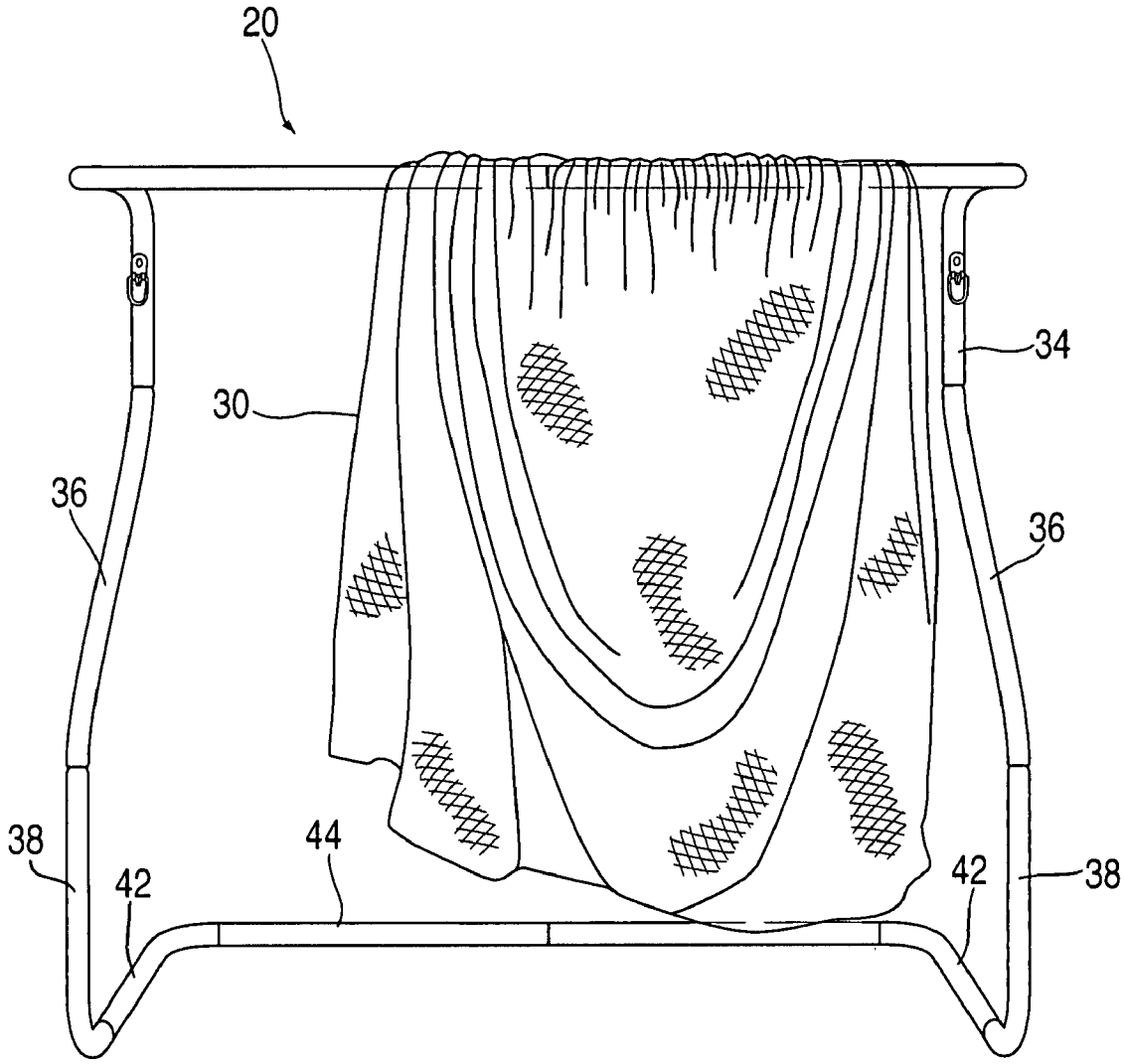
FIG. 3 shows a front view of the net compacted on the upper front transverse member during assembly of the multi-sports ball return net system of the present invention.
Figure 4:
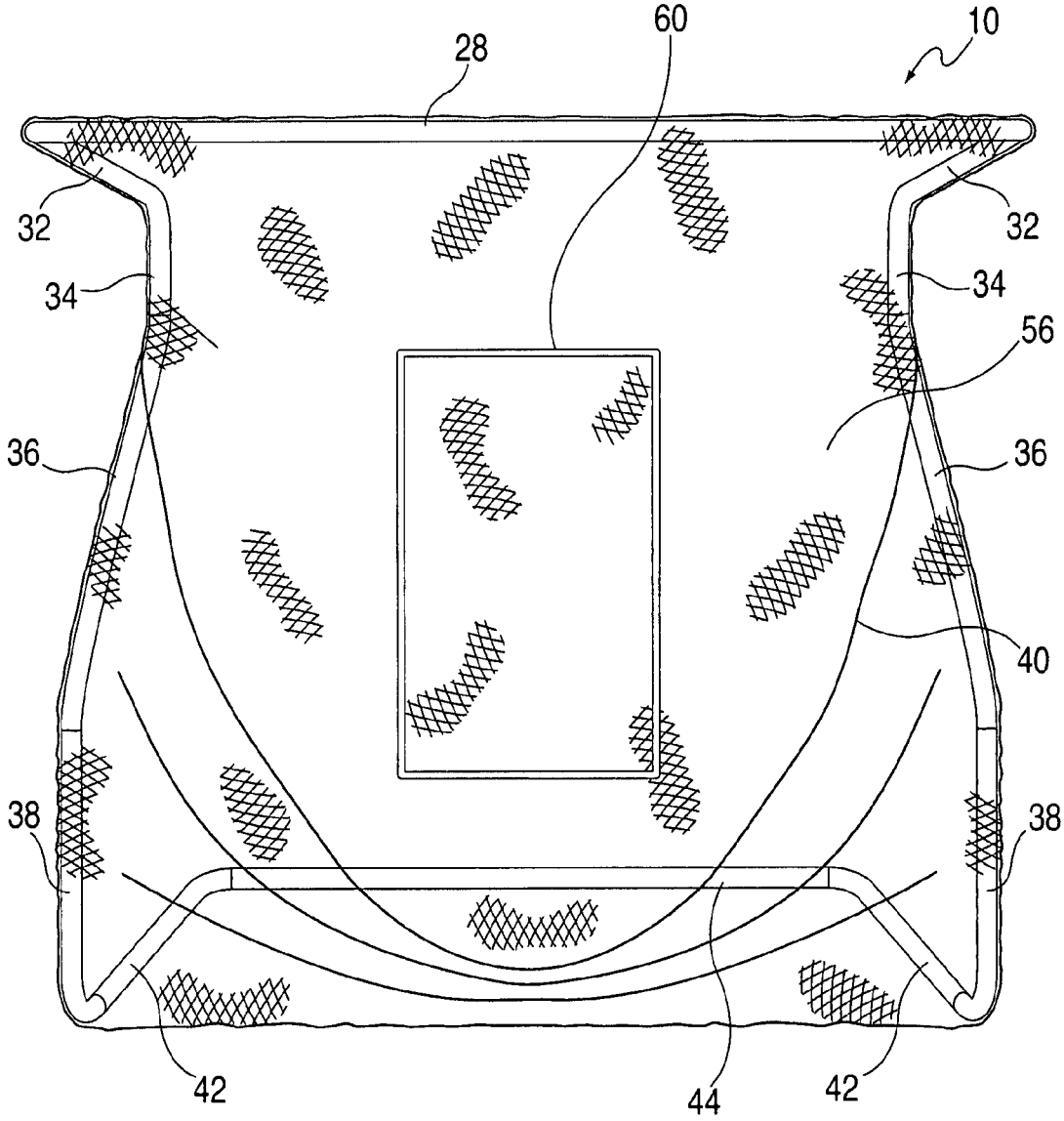
FIGS. 4 show a front view of the multi-sports ball return net system of the present invention.
Figure 5:
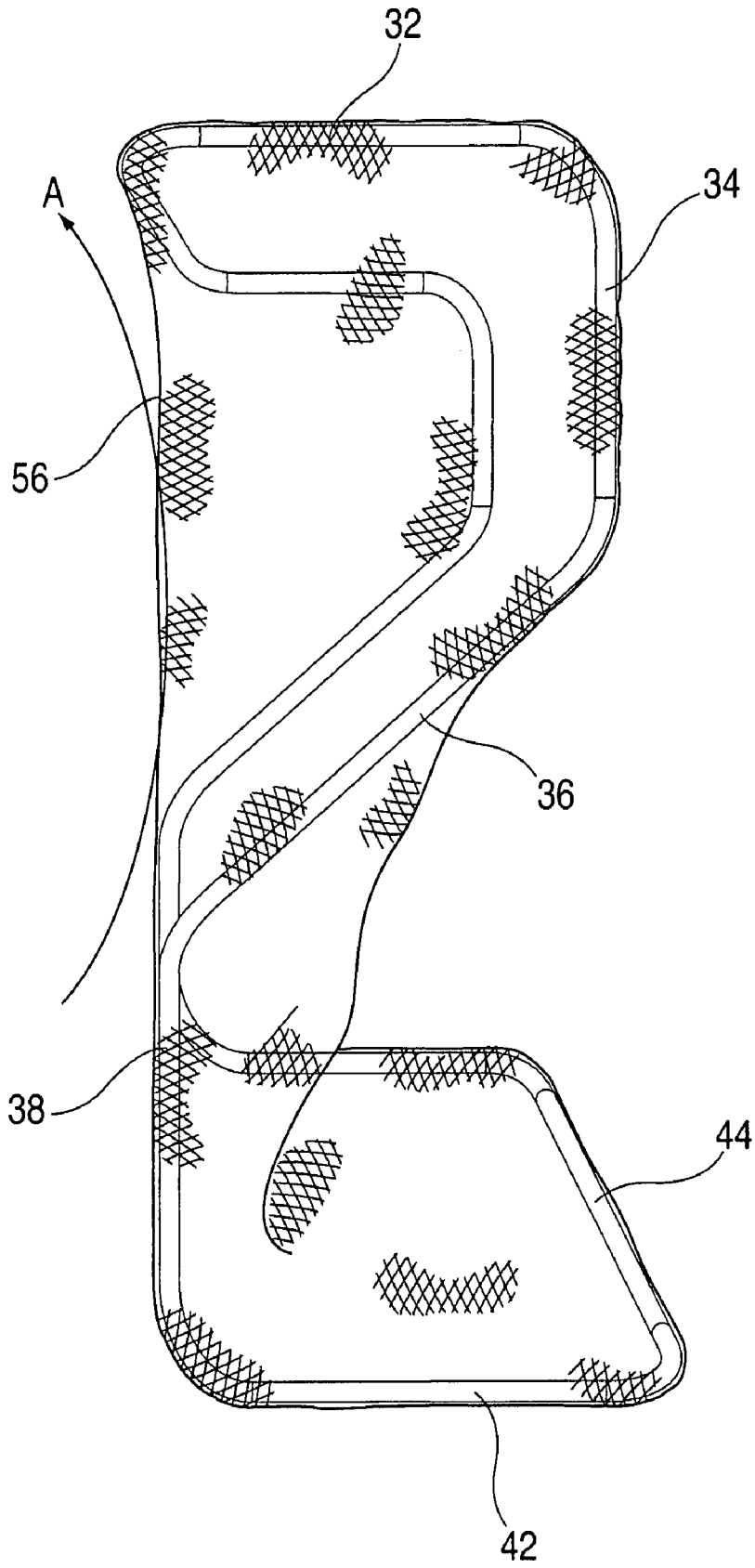
FIG. 5 shows a side view of the multi-sports ball return net system of the present invention.
Figure 6:
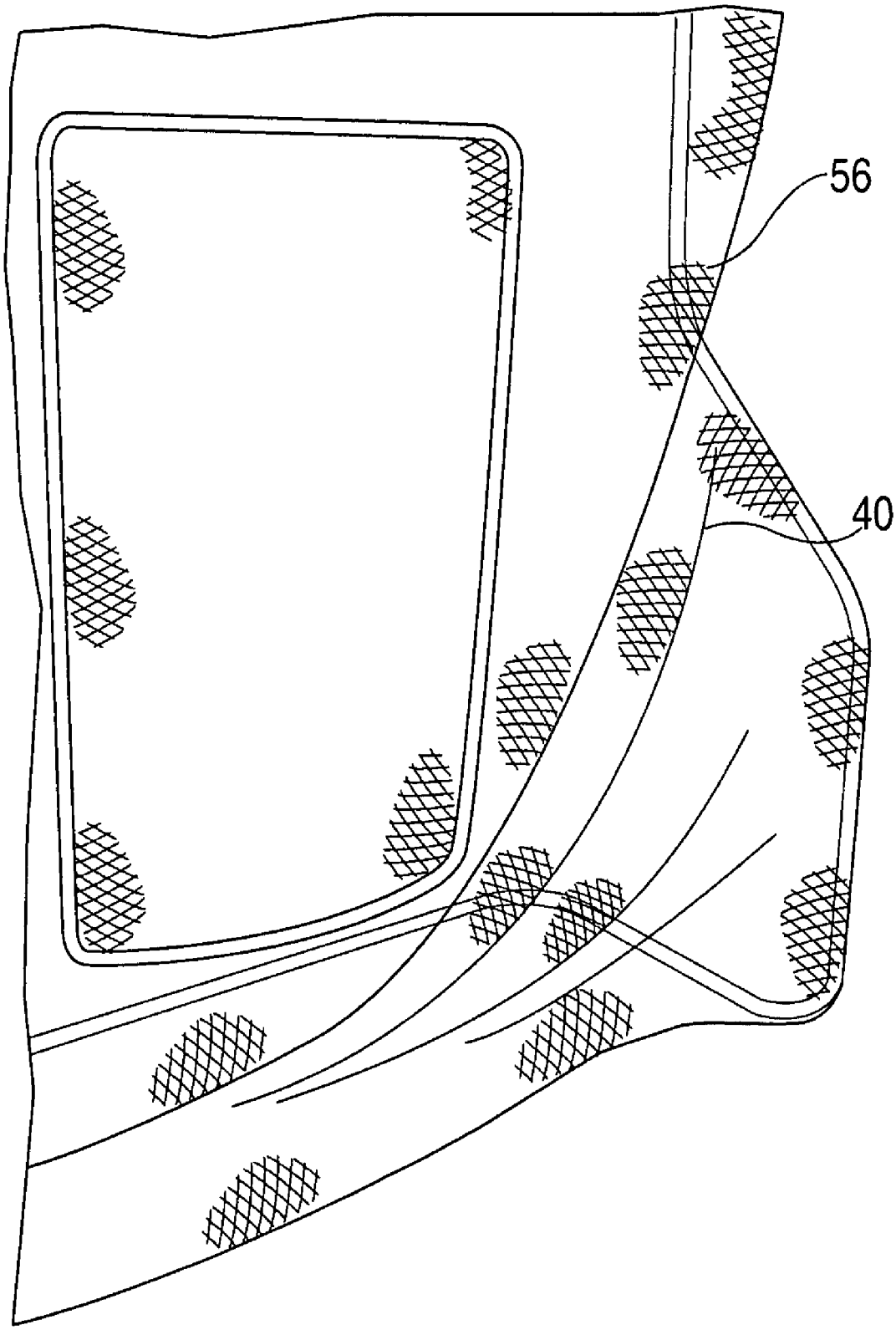
FIG. 6 shows a detail view of the U-shape channel formed on the net of the multi-sports ball return net system of the present invention.

The width of the longer parallel edge 46 of the net 30 is the same or slightly longer than the total length of the upper front transverse member 28 and the pair of parallel upper horizontal members 32. The height of the net 30 is longer than the height of the frame 20. For the frame 20 as shown in FIGS. 1 and 3, the net 30 has a width of 13' at the longer parallel edge 46, a width of 9' at the shorter parallel edge 54 and a height of 12'. The dimensions of the net 30 can vary correspondingly with the dimensions of the frame 20. The degree of tapering of the trapezoidal shape of the net 30 can vary and will result in slightly different ball return net systems 10, as will be discussed below. For tubular elements 22 that are 1.5" in diameter, the sleeve 48 may be 6" wide to allow unhindered movement along the tubular elements 22 of the frame 20.

The pattern and gauge of the net 30 may vary depending on the type and size of the ball the return net system 10 is used for. For example, diamond, triangle, square, other polygonal or non-polygonal shapes, etc. A heavier gauged net 30 provides a stronger arresting force to the ball. As an alternative to a heavier gauge net 30, small weights may be hung on the lower portion of the net 30.

As illustrated in FIG. 3, to assemble the net 30 onto frame 20, the sleeves 52 of the longer parallel edge 46 and side edges 48 are compacted and slipped over the upper front transverse member 28. Then the remaining members 32, 34, 36, 38, 42 and 44 of the frame 20 are interconnected to form frame 20. After full assembly of the frame 20, the net 30 is then mounted across the frame 20 such that the sleeve 52 of the longer parallel edge 46 is sleeved onto the upper front transverse member 28 and the pair of upper horizontal members 32 and each sleeve 52 of the side edges 48 is sleeved onto an upper vertical member 34, an intermediate inclined member 36 and a lower vertical member 38. The shorter parallel edge 54 gathers on the floor where the ball return net system 10 sits and towards the lower rear transverse member 44.

FIGS. 4A, 4B, 5 and 6 show the ball return net system 10 with the net 30 mounted on the frame 20. The net 30 is not tautly mounted across the frame 20. Due to the sizes and configurations of the frame 20 and the net 30, net 30 is loosely hung on the frame 20 and forms a U-shape channel or hammock 40 across the pair of intermediate inclined members 36. Above the U-shape channel 40 and below the upper front transverse member 28 is a U-shape forward bulging pillow 56. The U-shape pillow 56 defines the impact zone of the ball return net system 10 and the U-shape channel 40 defines the ball return zone of the ball return net system 10. A target 60 may be provided on the net 30 as a feedback tool for a user practicing consistent striking, hitting or kicking of a ball into the target 60. Target 60 may be sewn or painted onto any area of the net 30. Further, the target 60 can by any shape and size.

Figure 7:
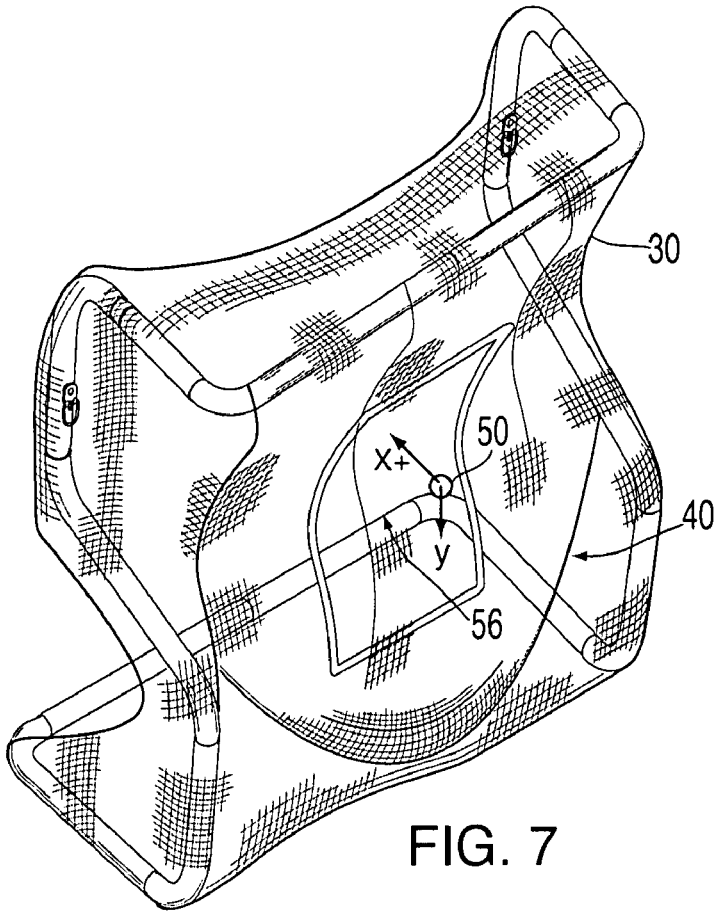
FIGS. 7 and 8 show the sequence of a ball 50 hitting into and being returned by the net 30 of the ball return net system 10 is returned.
Figure 8:
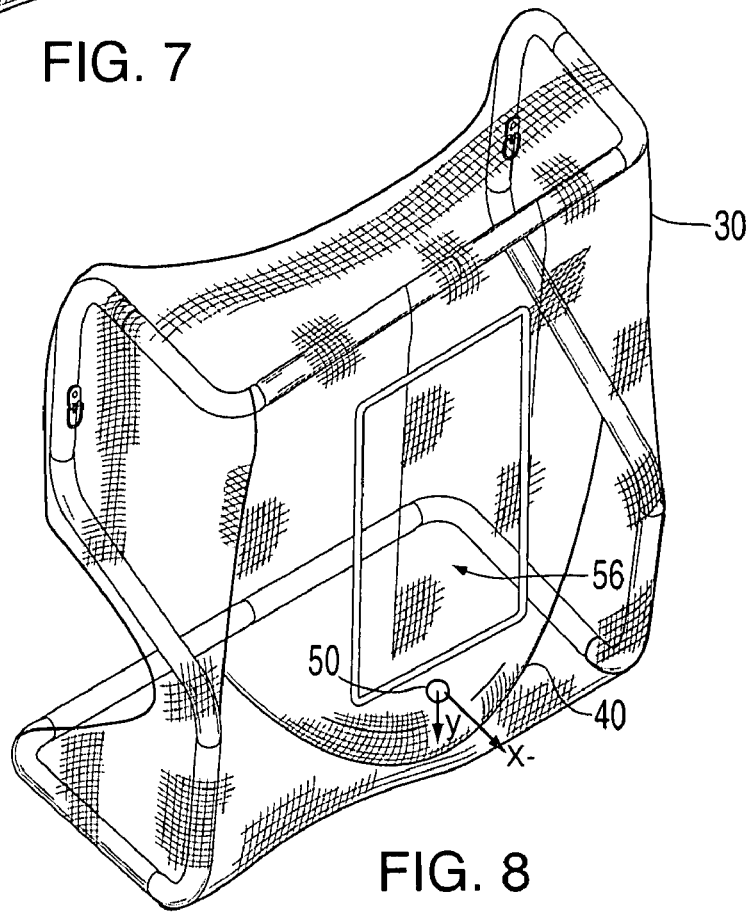

As shown in FIGS. 7 and 8, when a ball 50 is hit into the impact zone 56 of the net 30, the U-shape pillow 56 moves backward in the direction X+from the original vertical position (see FIG. 5) prior to impact. The net 30 absorbs the energy of the moving ball 50 to arrest its forward motion in the direction of X+. As the net 30 returns to its original position prior to the impact of the ball 50, the net 30 pushes the ball 50 in the direction of X−. The ball 50 rolls down towards the U-shape channel 40 (ball return zone) in the direction of Y. When the ball 50 reaches the lowest and central point of the U-shape channel 40, the ball 50 is released from the net 30. The combined forces in the X− and Y directions caused by the swinging/rocking of the net 30 and gravity, respectively, cause the ball 50 to have sufficient momentum and energy to roll directly towards the user who hit/strike/kick the ball 50 into the net 30. The spinning return of the ball 50 as a result of the forces in the X− and Y directions enhance the speed and distance of the return ball 50.

A ball 50 hit into the impact zone 56 of the net 30, regardless of whether it is centered or off-centered, the ball 50 rolls down towards the U-shape channel 40 (whether centrally or left or right sides of the U-shape channel), which then funnels the ball 50 towards the lowest and central point of the U-shape channel 40 for a consistent release and return of the ball 50 to the user in front of the net 30. As illustrated, a ball 50 is not randomly returned as in the prior art.

A ball 50 hit into the U-shape channel 40 similarly funnels the ball 50 towards the lowest and central point of the U-shape channel 40 for return to the user. A low ball 50 striking the net 30 below the impact zone 56 and the U-shape channel 40 may become trapped in the net 30 gathered on the ground below the U-shape channel 40, so as to prevent the ball 50 from exiting the back of the net 30 and becoming a dangerous trajectory.

Figure 9:
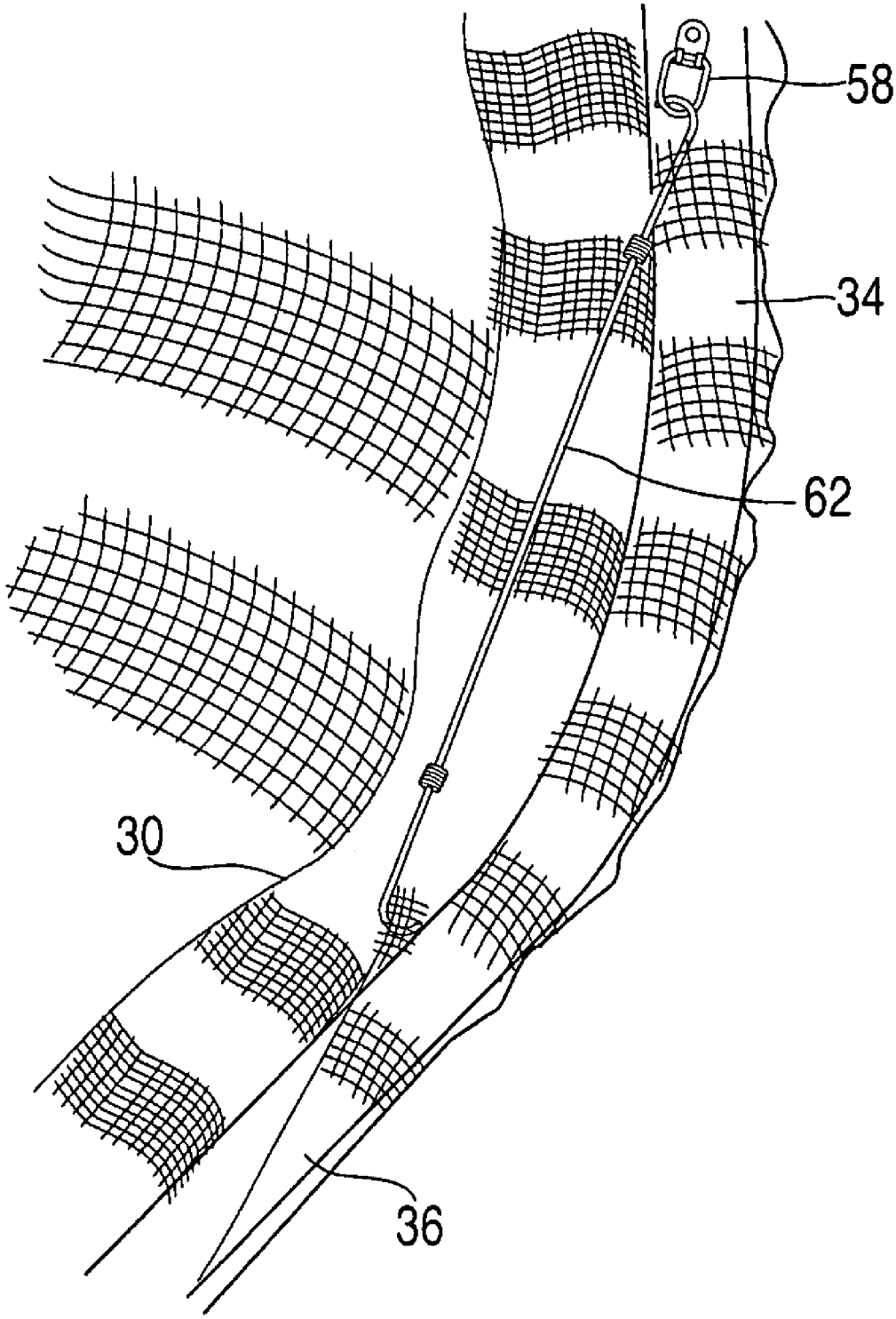
FIG. 9 is a detail view showing the raising of the U-shape channel with hook and cord.

The U-shape channel 40 of the net 30 may be adjusted and fine-tuned for different balls and return effects. The depth of the U-shape channel 40 may be adjusted by varying the ratio between the longer parallel edge 46 and the shorter parallel edge 54 of the net 30. A smaller ratio between the longer parallel edge 46 and the shorter parallel edge 54 provides a deeper U-shape channel 40. The lowest point of the U-shape channel 40 may be 1" to 18" off the ground by varying the dimensions of the net 30 or by raising the U-shape channel 40. The U-shape channel 40 may be raised by providing a hook 58 (as shown on FIG. 1) on the upper vertical member 34 of the frame 20 so that a cord 62 connected to the hook 58 may be used to pull the sleeve 52 of the side edge 48 of the net 30 upward along the intermediate inclined member 36 of the frame 20, as shown in FIG. 9. By raising the lowest point of the U-shape channel 40 higher above ground allows a ball 50 exiting the U-shape channel 40 to drop to the ground to create a bounce, for the return of a larger ball such as soccer. For the return of golf balls, where a rolling return is preferred to a bouncing return, the lowest point of the U-shape channel 40 is closer to the ground to avoid such a bounce.

Figure 10:
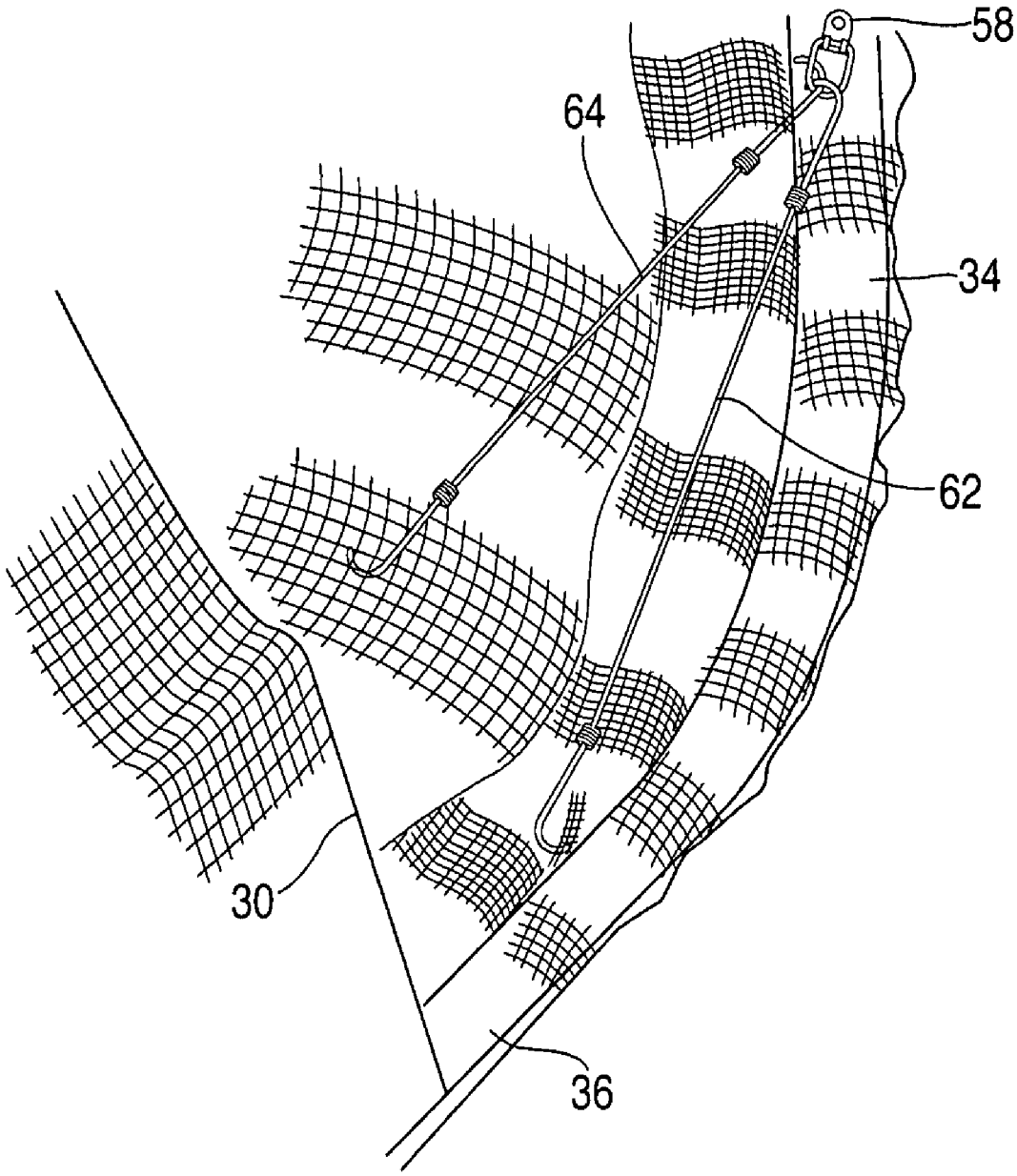
FIG. 10 is a detail view showing the angling of the impact zone with hook and cord.
Figure 11:
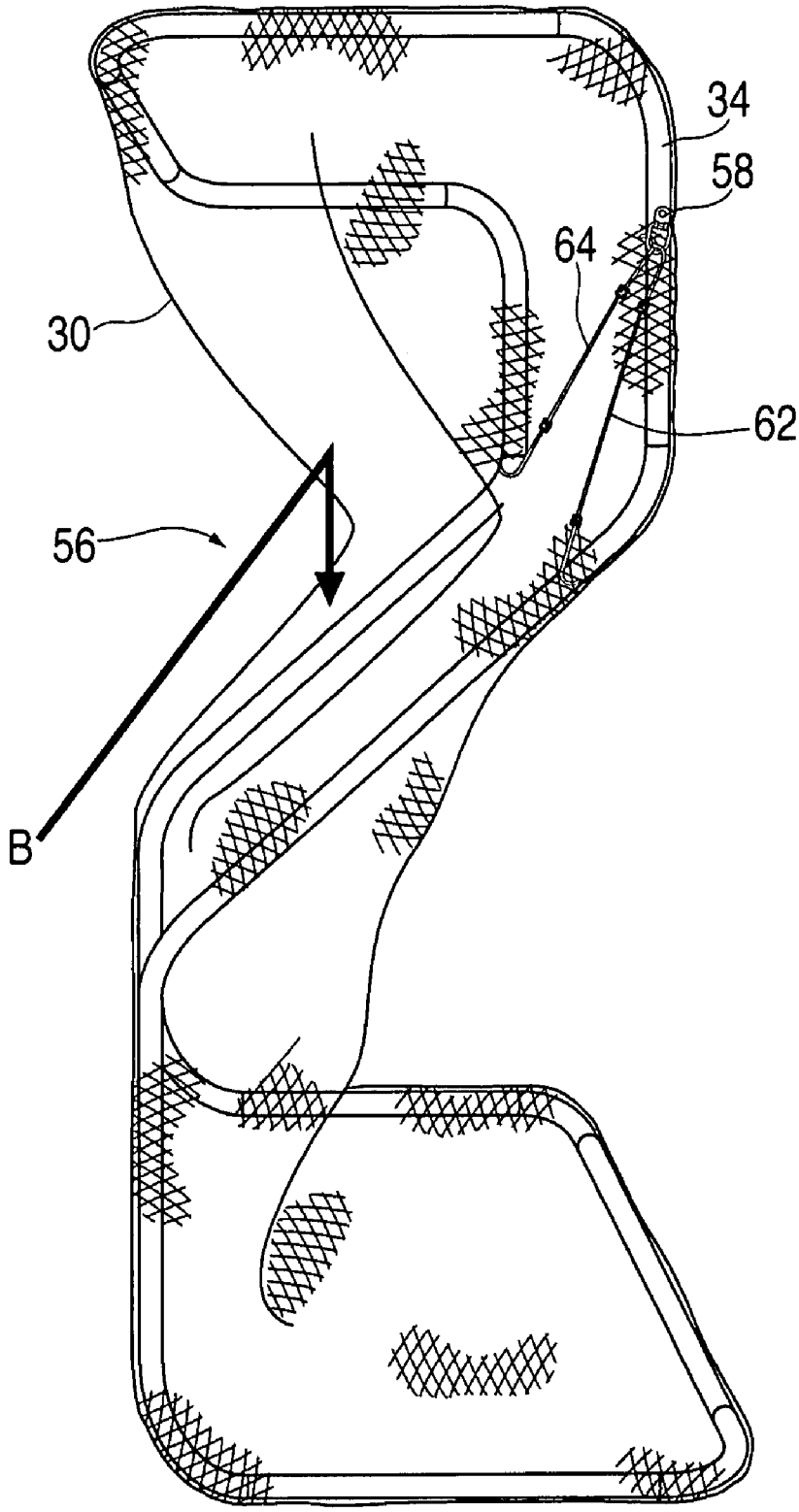
FIG. 11 is a side view of the multi-sports ball return net system of the present invention with an angled impact zone.

The impact zone 56 of the net 30 may also be adjusted and fine-tuned for different balls and return effects. As shown in FIGS. 10 and 11, the impact zone 56 may be angled backward by using a cord 64 connected to the hook 58 to pull back the impact zone 56 of the net 30, at a nearly 45 degree angle. Different angles can be achieved by pulling back from different points of the impact zone of the net 30. Angling the impact zone 56 of the net 30 prevents a ball that travels at a near vertical upward angle from skimming over and skipping off the surface of the net 30 and not returning the ball 50, as illustrated by arrow A in FIG. 5. By providing an angled impact zone 56, a ball 50 hit into it allows the net 30 to absorb the energy and arrest the movement of the ball 50 before rolling down to the U-shape channel 40 for return of the ball 50, as illustrated by arrow B in FIG. 11. An angled impact zone 56 works well with a user driving a golf ball 50 with a sand wedge or 9 Iron that produces a significant loft to the ball 50.

The shorter parallel edge 54 of the net 30 may be completely raised above ground to create a deeper U-shape channel 40 with the use of cord 62 connected to the hook 58. By pulling the lower end of sleeve 52 of side edge 48 of the net 30 upward along the intermediate inclined member 36 of the frame 20, the U-shape channel 40 forms a pocket above ground that collects balls 50 hit into the net 30. The creation of such a pocket is advantageous when the ground is wet or muddy.

The features of the invention illustrated and described herein is the preferred embodiment. Therefore, it is understood that the appended claims are intended to cover the variations disclosed and unforeseeable embodiments with insubstantial differences that are within the spirit of the claims.

We claim:

1. A system for returning a propelled ball directly back to a user who propelled the ball into the system, comprising:

a frame having an upper portion and two side portions; and a net attached to said upper and two sides portions defining an upper forward bulging portion and a lower generally U-shape channel portion across said two side portions of said frame wherein a ball propelled into said net is discharged from the lowest and central point of said U-shape channel portion directly back toward the user, wherein said net having a substantially isosceles trapezoidal shape comprises a longer parallel edge, two side edges and a shorter parallel edge.

2. The system of claim 1 wherein said frame further having a lower portion for self-supporting said frame in an upright position.

3. The system of claim 1 wherein said each side portion of said frame has a S-shape profile.

4. The system of claim 1 wherein said frame comprises a plurality of tubular elements having opposite ends interconnected to each other to form said frame.

5. The system of claim 4 wherein said frame further comprises means for interconnecting said plurality of tubular elements to each other.

6. The system of claim 5 wherein said interconnecting means comprises a tapered end and a non-tapered end at each tubular element to allow a tapered end of one tubular element to be inserted into to a non-tapered end of another tubular element.

7. The system of claim 6 wherein said interconnecting means further comprises a pushbutton at said tapered end and an opening at said non-tapered end to allow said pushbutton to be snapped into said opening upon the insertion of said tapered end of one tubular element into said non-tapered of another tubular element.

8. The system of claim 4 wherein said frame further comprises means for facilitating interconnection of said plurality of tubular elements.

9. The system of claim 8 wherein said facilitating means comprises a plurality of matching indicia at corresponding ends of each pair of tubular elements that are to be interconnected.

10. The system of claim 9 wherein said plurality of matching indicia is a plurality matching colors.

11. The system of claim 1 wherein said frame comprises fourteen tubular elements having opposite ends interconnected to each other to form said frame.

12. The system of claim 1 wherein said upper portion of said frame comprises an upper front transverse member having opposite ends and a pair of upper rearwardly extending horizontal members having opposite ends, wherein each end of said upper front transverse member is interconnected to one end of one of said pair of upper rearwardly extending horizontal members.

13. The system of claim 12 wherein each side portion of said frame comprises an upper downwardly extending vertical member having opposite ends, an intermediate downwardly extending and forwardly inclined member having opposite ends, and a lower downwardly extending vertical member having opposite ends, wherein the distal end of one of said pair of upper rearwardly extending horizontal members is interconnected to one end of said upper downwardly extending vertical member, the distal end of said upper downwardly extending vertical member is interconnected to one end of said intermediate downwardly extending and forwardly inclined member, and the distal end of said intermediate downwardly extending and forwardly inclined member is interconnected to one end of said lower downwardly extending vertical member.

14. The system of claim 13 wherein said frame further comprising a lower portion for self-supporting said frame in an upright position comprises a pair of lower rearwardly extending horizontal members having opposite ends and a lower rear transverse member having opposite ends, wherein the distal end of each of said lower downwardly extending vertical member is interconnected to one end of one of said pair of lower rearwardly extending horizontal members, and the distal ends of each lower rearwardly extending horizontal member are interconnected to each end of said rear transverse member.

15. The system of claim 14 wherein each side portion of said frame has a S-shape profile such that said upper front transverse member is in substantial vertical alignment with said lower downwardly extending vertical member and said lower rear transverse member is in substantial vertical alignment with said upper downwardly extending vertical member.

16. The system of claim 1 wherein said frame is made of a lightweight material.

17. The system of claim 1 wherein said frame is made of aluminum.

18. The system of claim 1 wherein said frame is made of plastic.

19. The system of claim 1 wherein said frame is made of polyvinyl chloride.

20. The system of claim 4 wherein each tubular element has a diameter of substantially 1.5 inch.

21. The system of claim 1 wherein each of said longer parallel edge and side edges having a sleeve for attaching to said upper and two sides portions of said frame.

22. The system of claim 21 wherein said upper portion of said frame having a predetermined length and said longer parallel edge of said net having a width greater than said predetermined length of said upper portion of said frame.

23. The system of claim 21 wherein each of said side portion of said frame having a predetermined length and side edge of said net having a height greater than said predetermined length of said side portion of said frame.

24. The system of claim 21 wherein said longer parallel edge of said net is sleeved onto said upper portion of said frame and each of said side edges of said net is sleeved onto each of said side portion of said frame.

25. The system of claim 1 wherein said longer parallel edge of said net is sleeved onto said upper front transverse member and said pair of upper rearwardly extending horizontal members defining said upper forward bulging portion, and each of said side edges of said net is sleeved onto said upper downwardly extending vertical member, said intermediate downwardly extending and forwardly inclined member, and said lower downwardly extending vertical member, wherein said lower generally U-shape channel portion is defined across said intermediate downwardly extending and forwardly inclined member of each side portion of said frame.

26. The system of claim 1 wherein said net further having a target provided thereon.

27. The system of claim 1 wherein said frame having a width of substantially 8 feet, a height of substantially 7 feet 5 inches and a depth of substantially 38 inches, and said longer parallel edge of said net being substantially 13 feet, said shorter parallel edge of said net being substantially 9 feet and said height of said net being substantially 12 feet.

28. The system of claim 1 further comprising a cord having two ends, wherein said frame further having a hook at one of said two side portions for receiving one end of said cord, and the other end of said cord being attached to said net to raise said lower generally U-shape channel portion in an upward direction.

29. The system of claim 1 further comprising a cord having two ends, wherein said frame further having a hook at one of said two side portions for receiving one end of said cord, and the other end of said cord being attached to said net to angle said upper forward bulging portion in a rearward direction.

30. A system for returning a propelled ball directly back to a user who propelled the ball into the system, comprising:

a frame having an upper portion and two side portions; and a net attached to said upper and two sides portions defining an upper forward bulging portion and a lower generally U-shape channel portion across said two side portions of said frame, said upper forward bulging portion of said net absorbs the energy of said propelled ball, which then drops to said lower generally U-shape channel portion of said net and funnels into the lowest and central point of said U-shape channel portion for discharge toward the user, wherein said net having a substantially isosceles trapezoidal shape comprises a longer parallel edge, two side edges and a shorter parallel edge.

31. A system for returning a propelled ball directly back to a user who propelled the ball into the system, comprising:

a frame comprises:

an upper front transverse member having opposite ends, a pair of upper rearwardly extending horizontal members having opposite ends, a pair of upper downwardly extending vertical member having opposite ends, a pair of intermediate downwardly extending and forwardly inclined member having opposite ends, a pair of lower downwardly extending vertical member having opposite ends, a pair of lower rearwardly extending horizontal members having opposite ends, and a lower rear transverse member having opposite ends, wherein each end of said upper front transverse member is interconnected to one end of one of said pair of upper rearwardly extending horizontal members, each distal end of said pair of upper rearwardly extending horizontal members is interconnected to one end of each of said pair of upper downwardly extending vertical members, each distal end of said pair of upper downwardly extending vertical members is interconnected to one end of each of said pair of intermediate downwardly extending and forwardly inclined members, each distal end of said pair of said intermediate downwardly extending and forwardly inclined members is interconnected to one end of each of said pair of lower downwardly extending vertical members, each distal end of each of said pair of lower downwardly extending vertical members is interconnected to one end of each of said pair of lower rearwardly extending horizontal members, and the distal ends of each of said pair of lower rearwardly extending horizontal members is interconnected to each end of said rear transverse member; and a net defining an upper forward bulging portion and a lower generally U-shape channel portion, having a substantially isosceles trapezoidal shape comprises a longer parallel edge having a sleeve, two side edges, each side edge having a sleeve, and a shorter parallel edge, wherein said longer parallel edge is sleeved onto said upper front transverse member and said pair of upper rearwardly extending horizontal members defining said upper forward bulging portion, and each of said side edges of said net is sleeved onto said upper downwardly extending vertical member, said intermediate downwardly extending and forwardly inclined member, and said lower downwardly extending vertical member, wherein said lower generally U-shape channel portion is defined across said intermediate downwardly extending and forwardly inclined member of each side portion of said frame, wherein a ball propelled into said net is discharged from the lowest and central point of said U-shape channel portion directly back toward the user.

32. A method of returning a propelled ball directly back to a user who propelled the ball, comprising the steps of:

providing a frame having an upper portion and two side portions;

providing a net attached to said upper and two side portions defining an upper forward bulging portion and a lower generally U-shape channel portion across said two side portions of said frame, wherein said net having a substantially isosceles trapezoidal shape comprises a longer parallel edge, two side edges and a shorter parallel edge;

propelling a ball into said upper forward bulging portion of said net;

absorbing the energy of the propelled ball with said net moving in the direction of the propelled ball;

returning the net to its original position allowing the ball to move in the direction opposite its propelled direction and into said lower generally U-shape channel portion of said net; and discharging the ball at the lowest and central point of said U-shape channel portion of said net directly toward the user.

33. The method of claim 32 wherein said upper portion of said frame comprises an upper front transverse member having opposite ends and a pair of upper rearwardly extending horizontal members having opposite ends, wherein each end of said upper front transverse member is interconnected to one end of one of said pair of upper rearwardly extending horizontal members.

34. The method of claim 33 wherein each side portion of said frame comprises an upper downwardly extending vertical member having opposite ends, an intermediate downwardly extending and forwardly inclined member having opposite ends, and a lower downwardly extending vertical member having opposite ends, wherein the distal end of one of said pair of upper rearwardly extending horizontal members is interconnected to one end of said upper downwardly extending vertical member, the distal end of said upper downwardly extending vertical member is interconnected to one end of said intermediate downwardly extending and forwardly inclined member, and the distal end of said intermediate downwardly extending and forwardly inclined member is interconnected to one end of said lower downwardly extending vertical member.

35. The method of claim 34 wherein said frame further comprising a lower portion for self-supporting said frame in an upright position comprises a pair of lower rearwardly extending horizontal members having opposite ends and a lower rear transverse member having opposite ends, wherein the distal end of each of said lower downwardly extending vertical member is interconnected to one end of one of said pair of lower rearwardly extending horizontal members, and the distal ends of each lower rearwardly extending horizontal member are interconnected to each end of said rear transverse member.

36. The method of claim 35 wherein said longer parallel edge of said net is sleeved onto said upper front transverse member and said pair of upper rearwardly extending horizontal members defining said upper forward bulging portion, and each of said side edges of said net is sleeved onto said upper downwardly extending vertical member, said intermediate downwardly extending and forwardly inclined member, and said lower downwardly extending vertical member, wherein said lower generally U-shape channel portion is defined across said intermediate downwardly extending and forwardly inclined member of each side portion of said frame.

* * * * *